United States Patent [19]

Wood

[11] 4,195,476

[45] Apr. 1, 1980

[54] COMBUSTOR CONSTRUCTION

[75] Inventor: Ronald M. Wood, Indianapolis, Ind.

[73] Assignee: General Motors Corporation, Detroit, Mich.

[21] Appl. No.: 900,757

[22] Filed: Apr. 27, 1978

[51] Int. Cl.[2] ..... F02G 3/00

[52] U.S. Cl. ..... 60/737; 60/39.32; 60/754; 60/760

[58] Field of Search ..... 60/39.65, 39.69, 39.66, 60/39.32

[56] References Cited

U.S. PATENT DOCUMENTS

| | | | |
|---|---|---|---|
| 2,727,566 | 12/1955 | Bonvillian et al. | 431/351 |
| 2,775,094 | 12/1956 | Buckland et al. | 60/39.65 |
| 3,016,703 | 1/1962 | Lorett et al. | 60/39.65 |
| 3,098,357 | 7/1963 | Marsh | 60/39.32 |
| 3,349,558 | 10/1967 | Smith | 60/39.65 |
| 3,651,514 | 9/1953 | Sherman | 60/39.65 |
| 3,656,298 | 4/1972 | Wade | 60/39.65 |
| 3,738,106 | 6/1973 | Stein et al. | 60/39.32 X |
| 3,869,864 | 3/1975 | Bunn | 60/39.65 |
| 3,916,619 | 11/1975 | Masai | 60/39.65 |
| 3,990,232 | 11/1976 | Campbell | 60/39.66 |

*Primary Examiner*—Carlton R. Croyle
*Assistant Examiner*—Edward Look
*Attorney, Agent, or Firm*—John C. Evans

[57] ABSTRACT

A gas turbine engine combustor assembly has an outer annular porous laminated wall and an inner annular porous laminated wall joined at one end thereof by an annular load support dome plate that closes one end of the combustor; peripheral extensions on the inlet end of each of the inner and outer walls are directed outwardly of a combustion zone to define a flame isolated connection surface on both of the laminated walls of the combustor and wherein connection means are provided to connect the dome plate to the connection surface to define inner and outer annular sealed joints at the combustor dome without blockage of coolant flow through the inner and outer porous laminated walls to maintain full cooling of the flame exposed inner surfaces of the inner and outer laminated walls and wherein the connection means are maintained out of direct flame exposed relationship with an interior combustion zone within the combustor.

4 Claims, 7 Drawing Figures

COMBUSTOR CONSTRUCTION

The invention herein described was made in the course of work under a contract or subcontract thereunder with the Department of Defense. This invention relates to gas turbine engine combustor assembles and more particularly to gas turbine engine combustor assemblies having inner and outer walls fabricated from laminated porous material for directing cooling air from exteriorly of the combustor to the inner wall surface thereof for transpiration cooling of the combustor interior surface.

Annular combustor assemblies are known that include means for providing air supply apertures to cool the interior of the flame tube during combustor operation. An example of such an arrangement is set forth in U.S. Pat. No. 3,869,864, issured Mar. 11, 1975, to Bunn. In this arrangement, separate wall sections and corrugated spacers are provided to define passages for the wall cooling air flow.

An object of the present invention is to simplify the construction of such annular combustors while maintaining a complete flow of cooling air to the interior surface of the combustor to protect the interior wall from a flame front within a combustion zone of the combustor and to do so by use of annular porous laminated walls joined by an annular combustor dome plate and wherein extensions are provided on the inlet end of the laminated annular walls and directed outwardly of a combustion zone within the combustor to define flame isolated connection surfaces that serve to interconnect a dome plate to the walls without blockage of coolant flow through the annular laminated walls and dome during combustor operation and wherein the connection means are located by the flared flanges at a point out of direct flame exposed relationship with the combustor combustion zone and wherein the connection means further serves to define a sealed joint at the inner and outer periphery of the dome which is both structurally sound and thermal fatigue resistant by being located in a cool temperature environment. Further objects and advantages of the present invention will be apparent from the following description, reference being had to the accompanying drawings wherein a preferred embodiment of the present invention is clearly shown.

Figure 1:
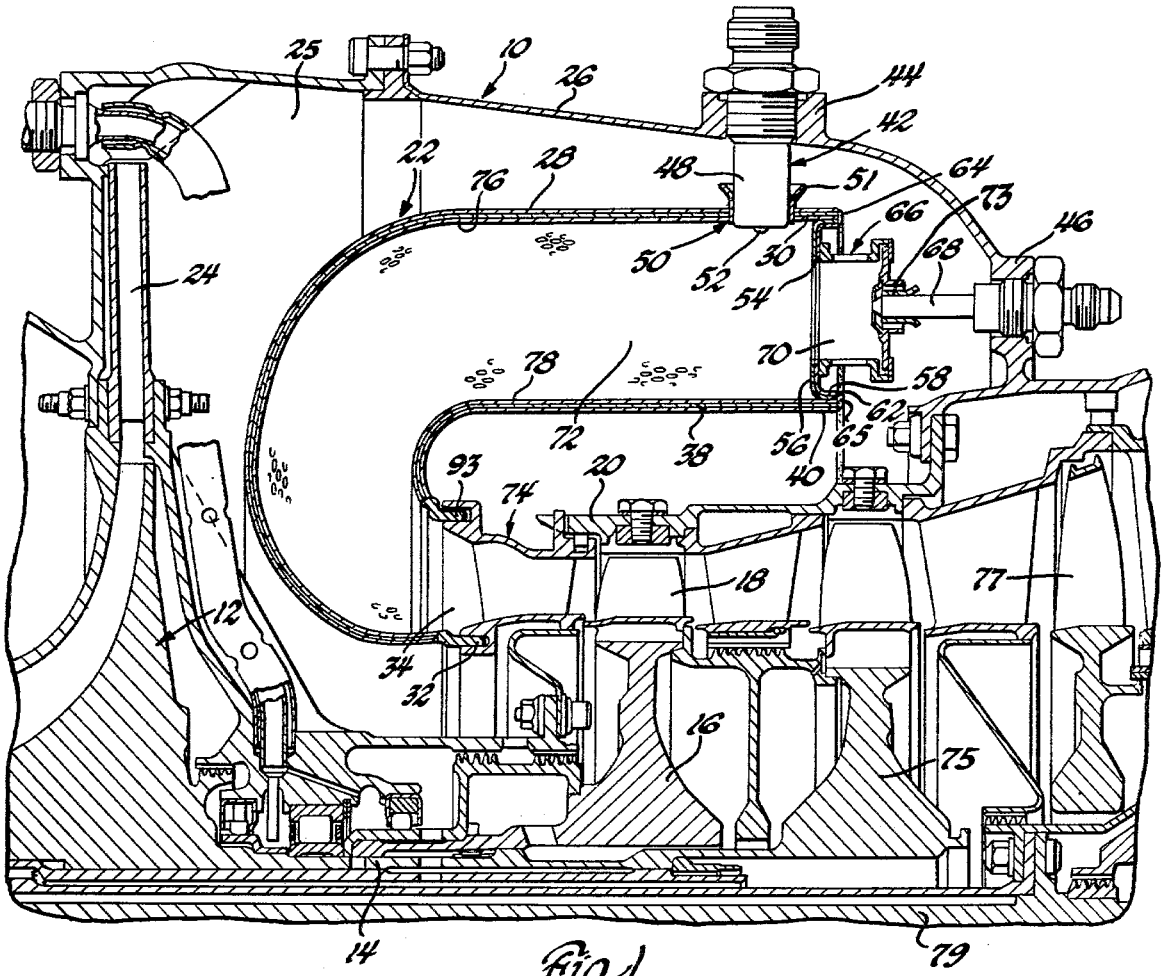
FIG. 1 is a view in longitudinal section of a gas turbine engine combustor including the present invention.

Referring now to FIG. 1, a gas turbine engine 10 is illustrated including a compressor 12 driven by a drive shaft 14 connected to a turbine rotor 16 having a plurality of blades 18 thereon and surrounded by an annular shroud 20. The turbine rotor 16 has motive fluid directed thereto from an improved, air cooled annular combustor 22. Air flow to the combustor 22 is from an annular diffuser 24 located downstream of the compressor 12. Diffuser 24 receives compressed air from compressor 12 and converts it from a high velocity state to a high pressure state at a combustor plenum space 25 enclosed by outer combustor case 26.

The combustor 22 more particularly is comprised of an outer annular curved wall 28 of porous laminated material including an inlet extension or flange 30 thereon and a solid metal outlet seal lip 32 thereon. The wall 28 is reversely bent on itself to form the inner path of an outlet flow passage 34 having the outer wall section thereof defined by a curved contour 36 that is part of the inner annular porous laminated wall 38 of the combustor 22 which is arranged in substantially spaced parallelism with the curvature of the outer wall 28. The wall 38 further includes an axial inlet extension or flange 40 thereon aligned parallel to the flange 30 and an outlet seal lip 93.

The combustor 22 is held in place by a pair of support plugs and a pair of igniter plugs 42. One of these four units is shown in FIG. 1 threadably received within a boss 44 on an outer combustor case 26.

Figure 2:
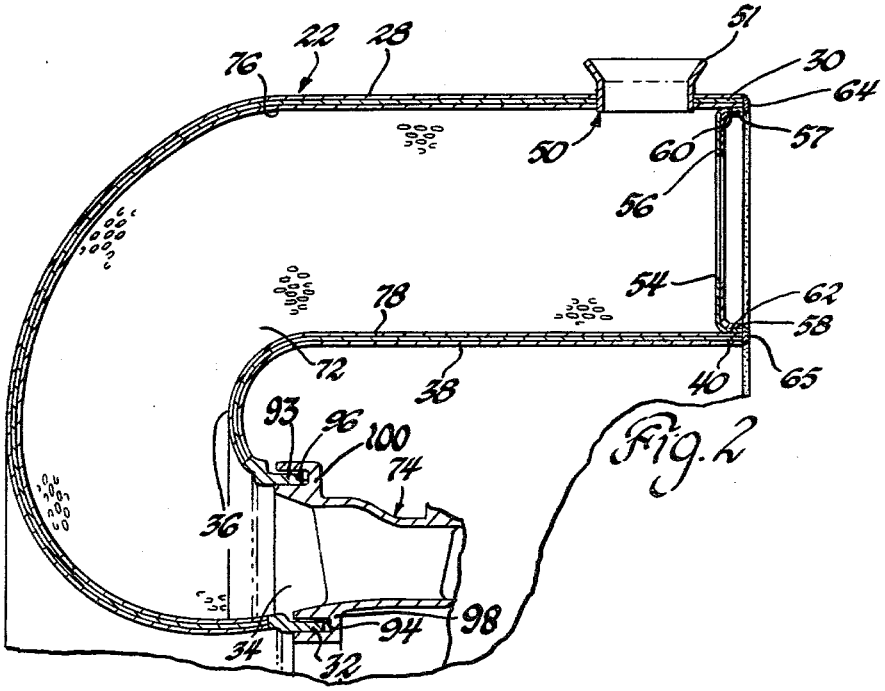
FIG. 2 is an enlarged longitudinal sectional view of a combustor including the present view.

In the illustrated arrangement the plug 42 includes an internal shank portion 48 thereon directed through a reinforcing ring 50 having an outwardly flared peripherally directed flange 51 thereon so as to locate the plug tip 52 immediately downstream of an air/fuel opening 54 in an annular porous dome plate 56 of the combustor 22. In FIG. 2, the dome 56 includes an annular outer flange 57 thereon and an annular inner flange 58 thereon located with respect to a flame isolated connection surface 60 on the extension 30 and a like flame isolated connection surface 62 on the inlet extension 40. The edges of the extensions 30, 40 are joined to adjacent edges on the flanges 57, 58 by means of annular edge weld 64 and annular edge weld 65, respectively, to define sealed joints between the dome 56 and the outer and inner porous laminated walls 28, 38 at the inlet ends thereof.

The opening 54 is associated with a swirler assembly 66 and an axially located fuel supply nozzle 68 for mixing fuel and air in a prechamber 70 prior to passage through the opening 54 into a downstream combustion zone 72 wherein the air and fuel mixture is burned with air from swirler 73 to produce a flame front for producing motive fluid directed through the outlet 34, thence through an annular nozzle ring 74.

The nozzle ring 74 directs the motive fluid across the turbine blades 18 to produce drive of the rotor 16 and a downstream gasifier turbine rotor 75. A downstream power turbine 77 drives a power shaft 79.

In accordance with certain principles of the present invention, each of the outer and inner annular walls 28, and dome 56 are fabricated from laminated porous material of the type set forth in U.S. Pat. No. 3,584,972, issued June 15, 1971, to Bratkovich et al, and air is directed through an array of pores therein to flow as coolant across a flame exposed inner surface 76 on wall 28, a flame exposed inner surface 78 on wall 38, and a flame exposed inner surface on dome 56.

A feature of the invention is that the dome 56 is supported and sealingly secured with respect to the porous laminated walls 28, 38 in a way that prevents interference of transpiration cooling of the exposed surfaces 76, 78. To do this, the edges 30, 40 are extended axially upstream of the combustion zone 72 to define connection surfaces 60, 62 exposed to the cool combustor inlet plenum air to cool them by conduction. The connection surfaces 60, 62 on flanges 30, 40 have an axial length which locate both the edge welds 64, 65 well out of direct flame exposed relationship with the combustion occurring within the zone 72. As a result, the dome 56 is maintained securely interconnected to the inner and outer walls 28, 38 and the connection therebetween is thereby removed from direct high temperature exposure during gas turbine engine operation. Moreover, the connection does not block coolant air which is free to flow from plenum 25 to cool the inner surface of dome 56 and the wall inner surfaces 76, 78 in the heat affected areas, that is, up to the point where the flanges and connection surfaces meet.

Figure 3:
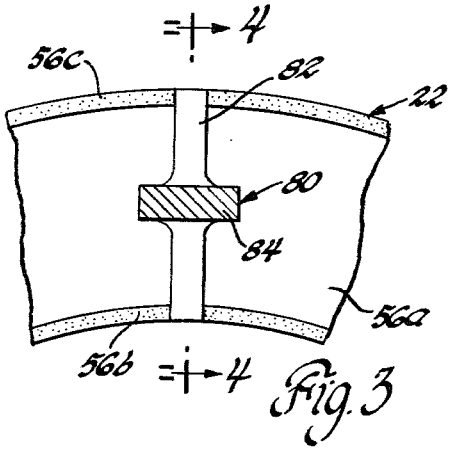
FIG. 3 is an end elevational view of an alternative mount arrangement.
Figure 4:
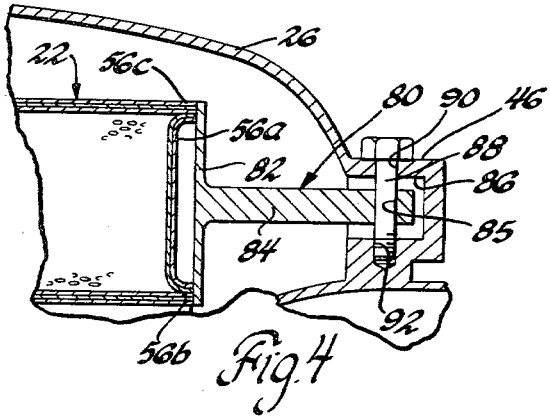
FIG. 4 is a vertical sectional view taken along the line 4—4 of FIG. 3 looking in the direction of the arrows.

A further feature of the present invention is that the sealed edge welds 64, 66 and the dome flanges 57, 58 are arranged to readily accommodate an alternative mounting arrangement for supporting the inlet end of the combustor 22 in a cantilevered relationship with respect to the outer case 26. More particularly, as shown in the modified support of FIGS. 3–4, four mounting attachments may be provided around the periphery of a dome **56*a* (equivalent to dome 56) at equidistantly spaced points therearound. As shown in FIG. 3, a support lug 80 has a vertical brace 82 welded at opposite ends thereon to the end surface of flanges 56*b*, 56*c*. The support lug 80 further includes an axial extension 84 thereon including a vertical bore 85 therethrough which is located in a groove 86 in a boss 46 on the end of the outer combustor case 26. The bore 85 receives a connection pin 88 that is directed through aligned openings 90, 92 in the boss 46 to secure the support lug 80 in an axial relationship with respect to the case 26. Consequently, the inlet dome 56*a* is likewise axially fixed with respect to the case 26 and thermal growth of the combustor 22 during gas turbine engine operation will cause the lips 32, 93 to shift axially within slots 94, 96 formed in inner and outer flanges 98, 100 of the turbine nozzle ring 74. Such growth likewise occurs in the case where plugs 42** are used as the support.

Figure 5:
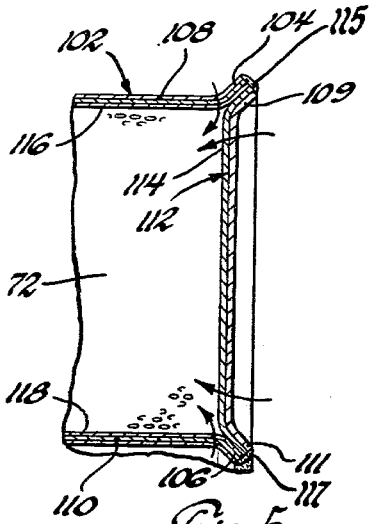
FIG. 5 is a fragmentary sectional view of an inlet dome end of a second embodiment of the present invention.

In the embodiment of the invention, shown in FIG. 5, an inlet end portion of a combustor 102 is shown having outwardly flared flanges or extensions 104, 106 formed on outer and inner walls 108, 110 of laminated porous material corresponding to walls 28, 38 of the combustor 22. As in the previous embodiment, the outwardly flared flanges 104, 106 are joined to flanges or edges 109, 111 of an inlet dome 112 by welds 115, 117 to allow full coolant flow through pores in the inner and outer walls and dome interior surfaces that are directly exposed to the hot gases from the combustion zone 72.

Figure 7:
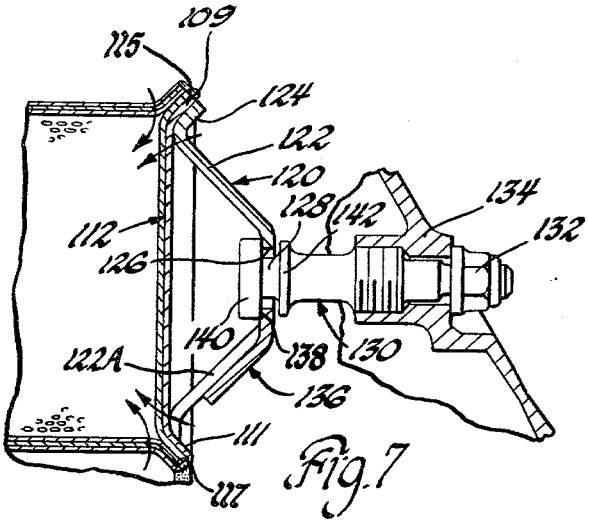
FIG. 7 is a vertical sectional view taken along the line 7—7 of FIG. 6 looking in the direction of the arrows.
Figure 6:
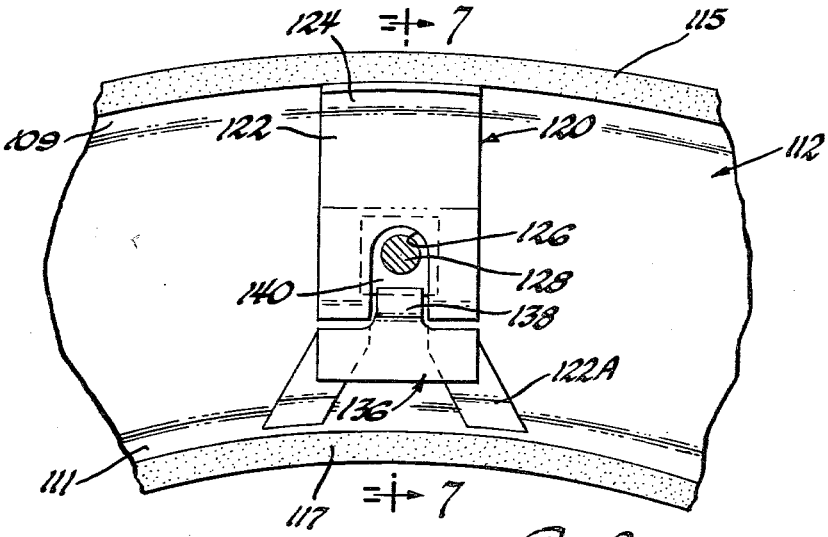
FIG. 6 is an end elevational view of another alternative mounting arrangement.

Moreover, the dome is configured to accommodate a mounting arrangement 120 as more specifically set forth in FIGS. 6 and 7. In this embodiment, an upper brace or clip 122 has an edge 124 bent to lie against edge 109. Clip 122 has a slot 126 that receives a small diameter axial segment 128 of a connector stud 130 fixed by a nut 132 to outer case 134. A lower clip 136 is secured to lower brace 122A and has a bent tab 138 located in slot 126 and radially inboard of stud flanges 140, 142 located on either side of segment 128. Thus, dome 112 is fixed axially with respect to the case 134 and allowed to grow radially outward within slot 126. As in the previous embodiment, four such assemblies are equidistantly arranged on dome 112.

By virtue of the aforesaid arrangements, combustor constructions of the type having porous metal walls are interconnected by a simplified dome construction that assures flow of coolant air completely across the full flame exposed inner surface of combustor assemblies and the dome construction is sealed with respect to the porous walls of the combustor construction by connectors maintained out of direct flame exposed relationship to the construction zone. Furthermore, the dome configuration is readily adapted to a wide variety of alternative mounting arrangements for axial fixation of the forward end of the combustor with respect to an outer case and to permit free radial growth of the forward end of the combustor with respect to the case and a fuel supply nozzle such as nozzle 68 in FIG. 1.

In the illustrated arrangement examples of suitable porous laminated materials for use in the combustor 22 are set forth in U.S. Pat. No. 3,584,972, issued June 15, 1971, to Bratkovich et al.

While the embodiments of the present invention, as herein disclosed, constitute a preferred form, it is to be understood that other forms might be adopted.

The embodiments of the invention in which an exclusive property or privilege is claimed are defined as follows:

1. A gas turbine engine combustor assembly located in an inlet air plenum comprising: an outer annular porous laminated wall, an inner annular porous laminated wall aligned with said outer wall to define a fuel combustion zone therebetween having opposite open ends, an annular porous laminated wall dome plate closing one of said open ends, an extension of porous laminated wall on the inlet end of each of said inner and outer annular walls, said extension being directed outwardly of the combustion zone to define a flame isolated connection surface on both the inner and outer laminated walls of the combustor at a point exposed to inlet plenum air, said dome plate having spaced, bent porous flanges thereon, and connection weld means connecting said dome plate flanges to said connection surfaces to define an annular sealed weld joint at said connection surfaces to close said one open end whereby coolant flow from exteriorly of the combustor assembly is free to flow across the full flamed exposed inner wall surfaces of the inner and outer wall and dome exposed to the combustion zone and wherein the connection means between said inner and outer walls and dome plate flanges is maintained out of direct flame exposed relationship with the combustion zone and in direct coolant flow relationship with inlet plenum air for maintenance of a secure, cool, thermal fatigue resistant connection between the annular dome plate and the inner and outer walls of the combustor assembly.

2. A gas turbine engine combustor assembly located in an inlet air plenum comprising: an outer annular porous laminated wall, an inner annular porous laminated wall aligned with said outer wall to define a fuel combustion zone therebetween having opposite open ends, an annular porous laminated wall dome plate closing one of said open ends, a porous flange on the inlet end of each of said inner and outer annular walls, said porous flanges being flared outwardly of the combustion zone to define extended length flame isolated connection surfaces on the inner and outer laminated walls of the combustor at a point exposed to inlet plenum air, said connection surfaces being arranged parallel to one another, said dome plate having spaced, bent porous flanges thereon, and connection weld means connecting said dome plate flanges to said connection surfaces to define annular weld sealed joints at the outer end of said connection surfaces to close said one open end and wherein the connection means between said inner and outer walls and dome plate flanges is maintained out of direct flame exposed relationship with the combustion zone and in direct coolant flow relationship with inlet plenum air for maintenance of a secure, cool, thermal fatigue resistant connection between the dome plate and the inner and outer walls of the combustor assembly.

3. A gas turbine engine combustor assembly located in an inlet air plenum, comprising: an outer annular porous laminated wall, an inner annular porous laminated wall aligned with said outer wall to define a fuel combustion zone therebetween having opposite open ends, an annular porous laminated wall dome plate closing one of said open ends, a porous flange on the inlet end of each of said inner and outer annular walls, said porous flanges being flared outwardly of the combustion zone to define a flame isolated connection surface on both the inner and outer laminated walls of the combustor at a point exposed to inlet plenum air, said connection surfaces being divergently formed to one another outboard of said dome plate, said dome plate having spaced, bent porous flanges thereon, and connection weld means connecting said dome plate flanges to said connection surfaces to define annular weld sealed joints at the outer end of said connection surfaces to close said one open end whereby coolant flow from exteriorly of the combustor assembly is free to flow across the full flamed exposed inner wall surfaces of the inner and outer wall and dome exposed to the combustion zone and wherein the connection means between said inner and outer walls and dome plate flanges is maintained out of direct flame exposed relationship with the combustion zone for maintenance of a secure, cool thermal fatigue resistant connection between the dome plate and the inner and outer walls of the combustor assembly.

4. A gas turbine engine combustor assembly located in an inlet air plenum comprising: an outer case, an outer annular porous laminated wall, an inner annular porous laminted wall aligned with said outer wall to define a fuel combustion zone therebetween having opposite open ends, an annular, load support dome closing one of said open ends, said dome being a porous laminated wall, a porous flange on the inlet end of each of said inner and outer annular walls, said porous flanges being flared outwardly of the combustion zone to define a flame isolated connection surface on both the inner and outer laminated walls of the combustor at a point exposed to inlet plenum air, said dome plate having spaced, bent porous flanges thereon, and connection weld means connecting said dome plate flanges to said connection surfaces to define annular weld sealed joints at said connection surfaces to close said one open end whereby coolant flow from exteriorly of the combustor assembly is free to flow across the full flame exposed inner wall surfaces of the inner and outer wall and dome exposed to the combustion zone and wherein the connection means between said inner and outer walls and dome plate is maintained out of direct flame exposed relationship with the combustion zone for maintenance of a secure, thermal fatigue resistant connection between the load support dome plate and the inner and outer walls of the combustor assembly, and a dome support bracket including a brace secured to the outer surface of said dome and an axial support member secured at one end to said brace and at the opposite end to said outer case.

* * * * *

UNITED STATES PATENT AND TRADEMARK OFFICE

CERTIFICATE OF CORRECTION

PATENT NO. : 4,195,476

DATED : April 1, 1980

INVENTOR(S) : Ronald M. Wood

It is certified that error appears in the above-identified patent and that said Letters Patent are hereby corrected as shown below:

| Column | Line | |
|---|---|---|
| 1 | 17 | "issured" should be -- issued --. |
| 1 | 61 | "Referring" should begin new paragraph. |
| 2 | 52 | "walls 28," should read -- walls 28, 38 --. |
| 3 | 14 | "66" should be -- 65 --. |
| 3 | 45 | "to flanges" should read -- to outer flanges --. |

Signed and Sealed this

Fourth Day of November 1980

[SEAL]

*Attest:*

SIDNEY A. DIAMOND

*Attesting Officer*

*Commissioner of Patents and Trademarks*